US009702282B2

(12) United States Patent
Peck et al.

(10) Patent No.: US 9,702,282 B2
(45) Date of Patent: Jul. 11, 2017

(54) CRANKCASE VENTILATION SYSTEM HEATER

(71) Applicant: CUMMINS FILTRATION IP, INC., Columbus, IN (US)

(72) Inventors: Lee A. Peck, Stoughton, WI (US); Arun P. Janakiraman, Stoughton, WI (US)

(73) Assignee: CUMMINS FILTRATION IP, INC., Columbus, IN (US)

( * ) Notice: Subject to any disclaimer, the term of this patent is extended or adjusted under 35 U.S.C. 154(b) by 0 days.

(21) Appl. No.: 15/110,869

(22) PCT Filed: Jan. 13, 2015

(86) PCT No.: PCT/US2015/011158

§ 371 (c)(1),
(2) Date: Jul. 11, 2016

(87) PCT Pub. No.: WO2015/108853

PCT Pub. Date: Jul. 23, 2015

(65) Prior Publication Data

US 2016/0333754 A1 Nov. 17, 2016

Related U.S. Application Data

(60) Provisional application No. 61/927,281, filed on Jan. 14, 2014.

(51) Int. Cl.
*F02M 25/06* (2016.01)
*F01M 13/04* (2006.01)

(52) U.S. Cl.
CPC ..... *F01M 13/04* (2013.01); *F01M 2013/0438* (2013.01); *F01M 2013/0472* (2013.01)

(58) Field of Classification Search
CPC ..... F01M 13/04; F01M 2013/0438; F01M 2013/0472; F01M 2013/0488; F02M 25/06
(Continued)

(56) References Cited

U.S. PATENT DOCUMENTS 2,895,508 A 7/1959 Drake
3,805,745 A 4/1974 Block et al.
(Continued)

OTHER PUBLICATIONS

Lemfeld et al., "Fin Spacing Effect of the Tube Fin Heat Exchanger at the Floor Heating Convector," world Academy of science, engineering and technology, vol. 6, May 25, 2012, pp. 111-114.
(Continued)

*Primary Examiner* — Hai Huynh
(74) *Attorney, Agent, or Firm* — Foley & Lardner LLP

(57) ABSTRACT

A crankcase ventilation system having a heat transfer conduit included therein. The system includes a housing and a crankcase ventilation filter element within the housing, the crankcase ventilation filter element configured to separate oil and oil aerosol from blow-by gases from a crankcase. An oil inlet is configured to receive pressurized oil from a component of an internal combustion engine. The conduit is positioned within the housing. The conduit is positioned along a length of the housing and is configured to carry the pressurized oil from the oil inlet to a component of the crankcase ventilation system. The conduit is configured to transfer thermal energy from the pressurized oil to the housing. An oil outlet is configured to return the pressurized oil to the crankcase.

22 Claims, 8 Drawing Sheets

(58) Field of Classification Search
USPC ..... 123/572–574
See application file for complete search history.

(56) References Cited

U.S. PATENT DOCUMENTS

| | | | | |
|---|---|---|---|---|
| 4,768,493 | A | 9/1988 | Ohtaka et al. | |
| 5,063,882 | A | 11/1991 | Koch et al. | |
| 6,216,343 | B1 | 4/2001 | Leland et al. | |
| 6,412,479 | B1 | 7/2002 | Canfield et al. | |
| 6,918,939 | B2 * | 7/2005 | Dworatzek | B01D 46/0087 210/450 |
| 7,699,029 | B2 | 4/2010 | Herman et al. | |
| 8,714,142 | B2 * | 5/2014 | Jacob | B01D 46/0031 123/41.86 |
| 8,794,222 | B2 * | 8/2014 | Schwandt | F01M 13/04 123/196 A |
| 9,545,591 | B2 * | 1/2017 | Parikh | B01D 46/2403 |
| 2010/0186686 | A1 | 7/2010 | Cattani et al. | |
| 2011/0180051 | A1 | 7/2011 | Schwandt et al. | |
| 2016/0348550 | A1 * | 12/2016 | Zuerker | B01D 46/2411 |
| 2016/0348790 | A1 * | 12/2016 | Zuerker | F16J 15/062 |

OTHER PUBLICATIONS

International Search Report and Written Opinion for PCT/US2015/011158, issued May 6, 2015, 11 pages.

* cited by examiner

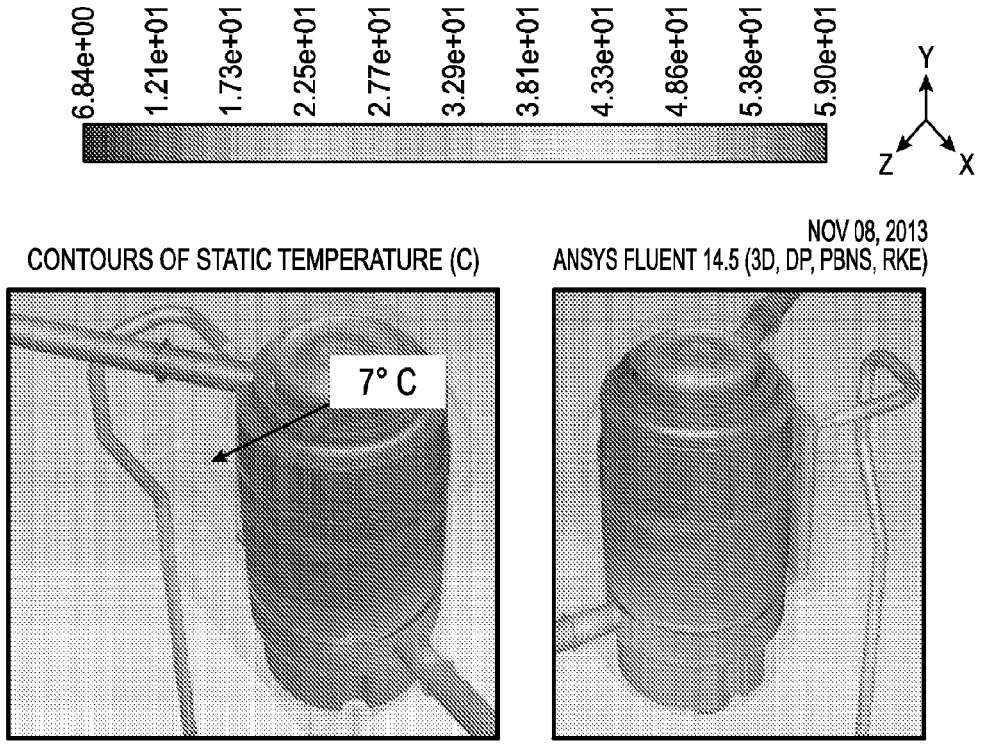

| THERMAL CFD INPUTS | | | |
|---|---|---|---|
| **CONDITION 1 IDLE** | | **CONDITION 2 CRUISE** | |
| AMBIENT AIR FLOW VELOCITY | 0 | AMBIENT AIR FLOW VELOCITY | 4 M/S |
| AMBIENT AIR FLOW DIRECTION | 0 | AMBIENT AIR FLOW DIRECTION | FRONT-TO-BACK |
| | | | |
| BLOW BY FLOW RATE | 1 CFM | BLOW BY FLOW RATE | 3.5 CFM |
| BLOW BY TEMPERATURE | 20 C | BLOW BY TEMPERATURE | 50 C |
| AMBIENT AIR TEMPERATURE | -40 C | AMBIENT AIR TEMPERATURE | -40 C |
| | | | |
| OIL PRESSURE | 15 PSIG | OIL PRESSURE | 35 PSIG |
| OIL TEMPERATURE | 50 C | OIL TEMPERATURE | 60 C |
| | | | |
| DISTANCE TO HOTTEST COMPONENT | N/A | DISTANCE TO HOTTEST COMPONENT | N/A |
| TEMP OF HOTTEST COMPONENT | N/A | TEMP OF HOTTEST COMPONENT | N/A |

FIG. 5

CRANKCASE VENTILATION SYSTEM HEATER

CROSS-REFERENCE TO RELATED APPLICATIONS

This application is a U.S. national stage application claiming the benefit of International Application No. PCT/US2015/011158, filed on Jan. 13, 2015, which claims priority to U.S. Provisional Patent Application No. 61/927,281, entitled "CRANKCASE VENTILATION SYSTEM HEATER," filed on Jan. 14, 2014. Both applications are herein incorporated by reference in their entirety and for all purposes.

TECHNICAL FIELD

The present application relates to crankcase ventilation ("CV") systems for internal combustion engines. More particularly, the present application relates to a heating system for a CV system that heats the CV system utilizing engine oil.

BACKGROUND

During the combustion cycle of conventional internal combustion engines, some combustion gases may leak past the piston rings of the cylinder and into the crankcase. These leaked gases are often referred to as blow-by gases. Crankcase ventilation ("CV") systems are employed to vent the blow-by gases from the crankcase. Some CV systems are open loop systems, meaning the blow-by gases are vented to the ambient environment. Other CV systems are closed loop systems, meaning the blow-by gases are returned to the engine for combustion.

Many CV systems include a crankcase ventilation filter that allows the blow-by gases to be swept out of the crankcase (e.g., out of a road draft tube, into the engine intake, etc.). The crankcase ventilation filter may be a coalescing filter, a ventilation rotating filter, an inertial separator, a rotating cone stack filter, or the like. The crankcase ventilation filter may assist in treating the blow-by gases to reduce environmental impact of the internal combustion engine.

In some arrangements, the CV filter may be susceptible to cold temperatures. The cold temperatures may cause solidification of liquids in outlets (e.g., water vapor in the blow-by gases to freeze), which may plug the outlet. If an outlet of the CV system becomes plugged, pressure may build within the CV system and damage the CV system and possibly the engine itself. The plugging of CV system outlets due to cold conditions is a greater risk in CV systems having the CV filter mounted external to an engine cavity.

Some CV systems utilize a heating element that requires a source of energy outside of the internal combustion engine itself (i.e., a heating component having a primary function of heating the CV filter). For example, some CV systems utilize electric heating elements to directly heat the CV filter. As another example, some CV systems may utilize a separate coolant system to pass heated coolant through the CV filter. Still, other CV systems may utilize insulation, such as an over-molded insulation on plastic housings for the CV system parts, to protect the CV filter from cold temperatures. However, insulation alone does not generate heat. Accordingly, some CV systems may utilize both a heating element that requires a source of energy outside of the internal combustion engine itself and insulation. Utilizing a heating element that requires a source of energy outside of the internal combustion engine itself requires additional components and may negatively impact the overall efficiency of the engine.

SUMMARY

A first embodiment relates to a crankcase ventilation system. The system includes a housing and a crankcase ventilation filter element within the housing. The crankcase ventilation filter element is configured to separate oil and oil aerosol from blow-by gases from a crankcase. An oil inlet is configured to receive pressurized oil from a component of an internal combustion engine. A conduit is positioned within the housing, the conduit positioned along a length of the housing. The conduit is configured to carry the pressurized oil from the oil inlet to a component of the crankcase ventilation system. The conduit is configured to transfer thermal energy from the pressurized oil to the housing. The system also includes an oil outlet configured to return the pressurized oil to the crankcase.

Another embodiment relates to a housing for a crankcase ventilation system. The housing includes a cavity configured to house a crankcase ventilation filter element within the housing. An oil inlet is configured to receive pressurized oil from a component of an internal combustion engine. A conduit is positioned within the housing, the conduit positioned along a length of the housing. The conduit is configured to carry the pressurized oil from the oil inlet to a component of the crankcase ventilation system. The conduit is configured to transfer thermal energy from the pressurized oil to the housing. The system also includes an oil outlet configured to return the pressurized oil to the crankcase.

These and other features, together with the organization and manner of operation thereof, will become apparent from the following detailed description when taken in conjunction with the accompanying drawings.

BRIEF DESCRIPTION OF THE FIGURES

FIGS. 5-7 are various thermal diagrams of crankcase ventilation filter housings according to various exemplary embodiments.

DETAILED DESCRIPTION OF VARIOUS EMBODIMENTS

Referring to the figures generally, the various embodiments disclosed herein relate to a crankcase ventilation ("CV") system having a CV filter heating system that utilizes engine oil to heat the CV filter. The engine oil is already heated during normal operation of the internal combustion engine. In some arrangements, engine oil may be provided to the CV system to drive a pelton wheel that rotates the CV filter or to form a jet pump that draws separated oil from the CV system back into the crankcase. In present disclosure, the engine oil is also routed through a heat transfer device that transfers heat from the already heated engine oil to the CV filter, thereby protecting the CV filter from freeze up due to cold ambient conditions.

Figure 1:
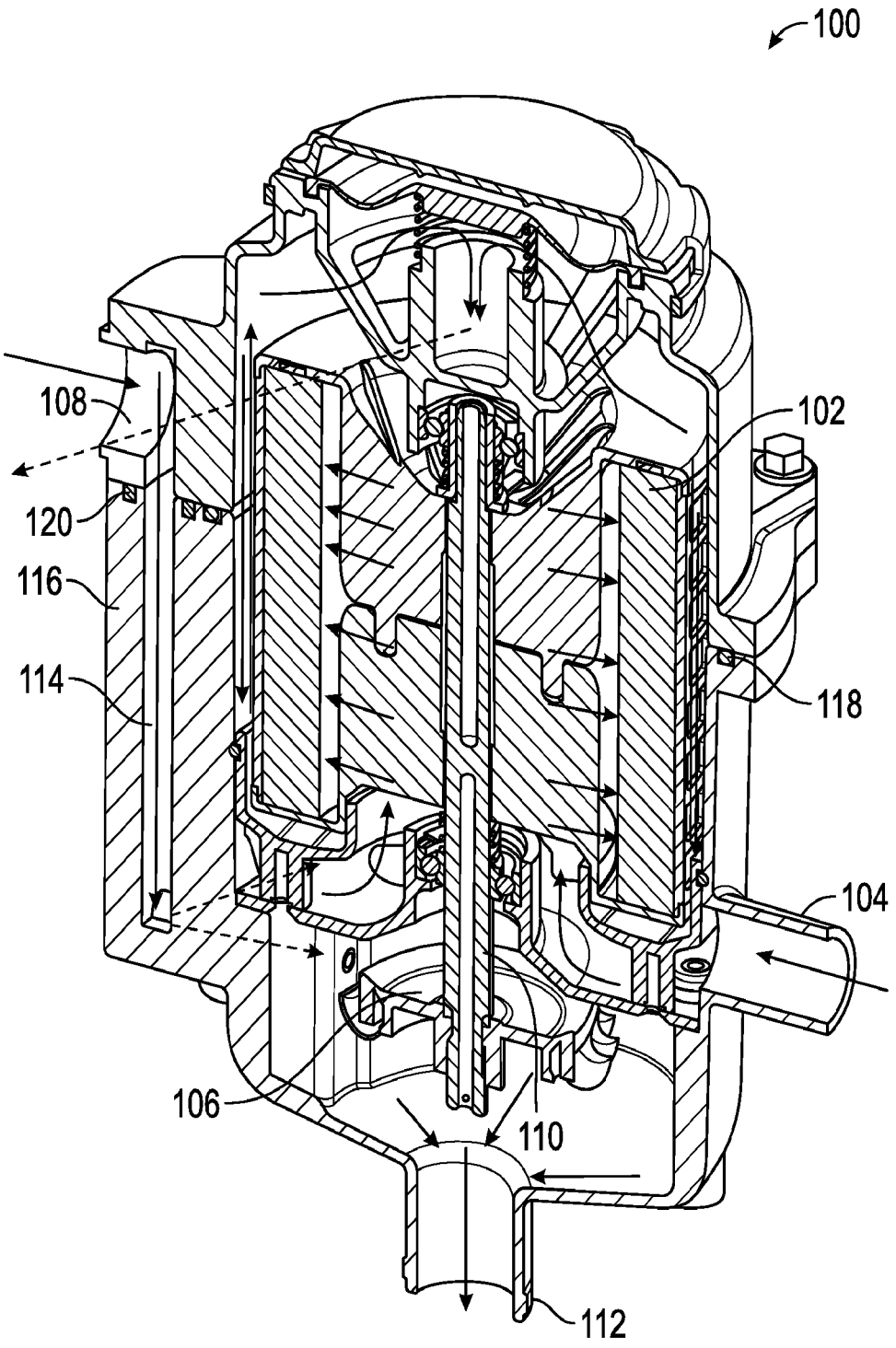
FIG. 1 is a cross-sectional views of a rotating coalescer for a CV system of an internal combustion engine according to an exemplary embodiment.

Referring to FIG. 1, a cross-sectional views of a rotating coalescer 100 for a CV system of an internal combustion engine is shown according to an exemplary embodiment. The rotating coalescer 100 includes an annular rotating coalescing filter element 102. Although the filter element 102 is drawn as a cylindrical filter, the filter element 102 may also comprise a rotating cone stack filter. The filter element 102 is configured to filter blow-by gas received through inlet 104. The blow-by gas typically includes combustion gases that have leaked past the piston rings of the cylinder and into the crankcase. The blow-by gas may also carry oil from the engine and/or from the crankcase. The filter element 102 is configured to separate the oil aerosol from the oil contained in the blow-by gas. The filter element 102 is rotated during filtering operations to increase the efficiency of the filtering of the blow-by gas. The filter element 102 is rotationally driven by a fluid motor 106 (e.g., a pelton or turbine drive wheel). The fluid motor 106 is powered by engine oil provided through an oil inlet 108. The oil inlet 108 is connected to a pressurized engine oil source. The engine oil flows through the oil inlet 108 and is directed into the fluid motor 106 such that the fluid motor 106 rotates. The engine oil may be directed into the fluid motor 106 through a plurality of cross-drillings. The rotation of the fluid motor 106 rotates a shaft 110, which in turn drives the rotation of the filter element 102. After driving the fluid motor 106, the oil is returned to the crankcase via an oil outlet 112. Oil separated from the blow-by gases by the filter element 102 may also return to the crankcase via the oil outlet 112. The oil aerosol separated from the blow-by gases may be returned to the engine for combustion or may be ejected from the rotating coalescer 100 into the external environment. Further details of the operation of a rotating coalescer are described in detail in U.S. patent application Ser. No. 12/969,742, entitled "CRANKCASE VENTILATION INSIDE-OUT FLOW ROTATING COALESCER," filed on Dec. 16, 2010, and assigned to Cummins Filtration IP, Inc., which is hereby incorporated by reference in its entirety and for all purposes.

In the present embodiment, the engine oil received through oil inlet 108 also serves to heat the rotating coalescer 100. The oil is routed through a conduit 114. The conduit 114 may comprise a channel or similar passageway which is formed directly in the housing 116 of the rotating coalescer 100. Alternatively, the conduit 114 may be part of a separate component that is mounted to the housing 116. The housing 116 may be formed out of a metal. The metal may have a high thermal conductivity and may comprise, for example, aluminum. The conduit may include a high thermal conductivity material insert. For example, the housing 116 may be formed from steel or iron, and the conduit 114 may be lined with copper, which has a higher thermal conductivity than steel and iron. Alternatively or additionally, the conduit 114 may include internal fins or ribs configured to increase the surface area in contact with the oil routed through the conduit 114, thereby increasing the heat transfer from the oil to the housing 116. The internal fins or ribs may also be configured to cause flow turbulence in the oil flowing through the conduit thereby increasing the nusselt number of the system and increases the heat transfer from the oil to the housing 116. In some arrangements, the conduit 114 may include an internal honeycomb-like channels formed out of a metal. The honeycomb-like channels increase the surface area thereby increasing the heat transfer rate from the oil to the housing 116. In further arrangements, the conduit 114 may include sinusoidal flow channels that create oscillatory flows that increase the heat transfer rate from the oil to the housing 116. In some arrangements, the conduit 114 may be split into multiple parallel channels. The conduit may run along a length of the housing 116. As shown in FIG. 1, the housing 116 may be comprised of two sections bolted together. A first seal 118 may be provided between the two sections. The conduit 114 may extend across the two sections. A second seal 120 may be provided between the two sections around the conduit 114. The engine oil, prior to entering the rotating coalescer through oil inlet 108, may be heated above the ambient environmental temperature. The engine oil may be heated by the normal operation of the internal combustion engine. In alternative arrangements, the engine oil may be heated by a secondary heating system external to the rotating coalescer 100. Accordingly, as the heated engine oil is routed through the conduit 114, thermal energy from the engine oil is transferred to the housing 116 to provide freeze protection to the components of the rotating coalescer 100. The conduit 114 may be shaped to have a semi-circular cross-section to increase the surface area for heat transfer from the heated engine oil to the rotating coalescer 100.

Figure 2:
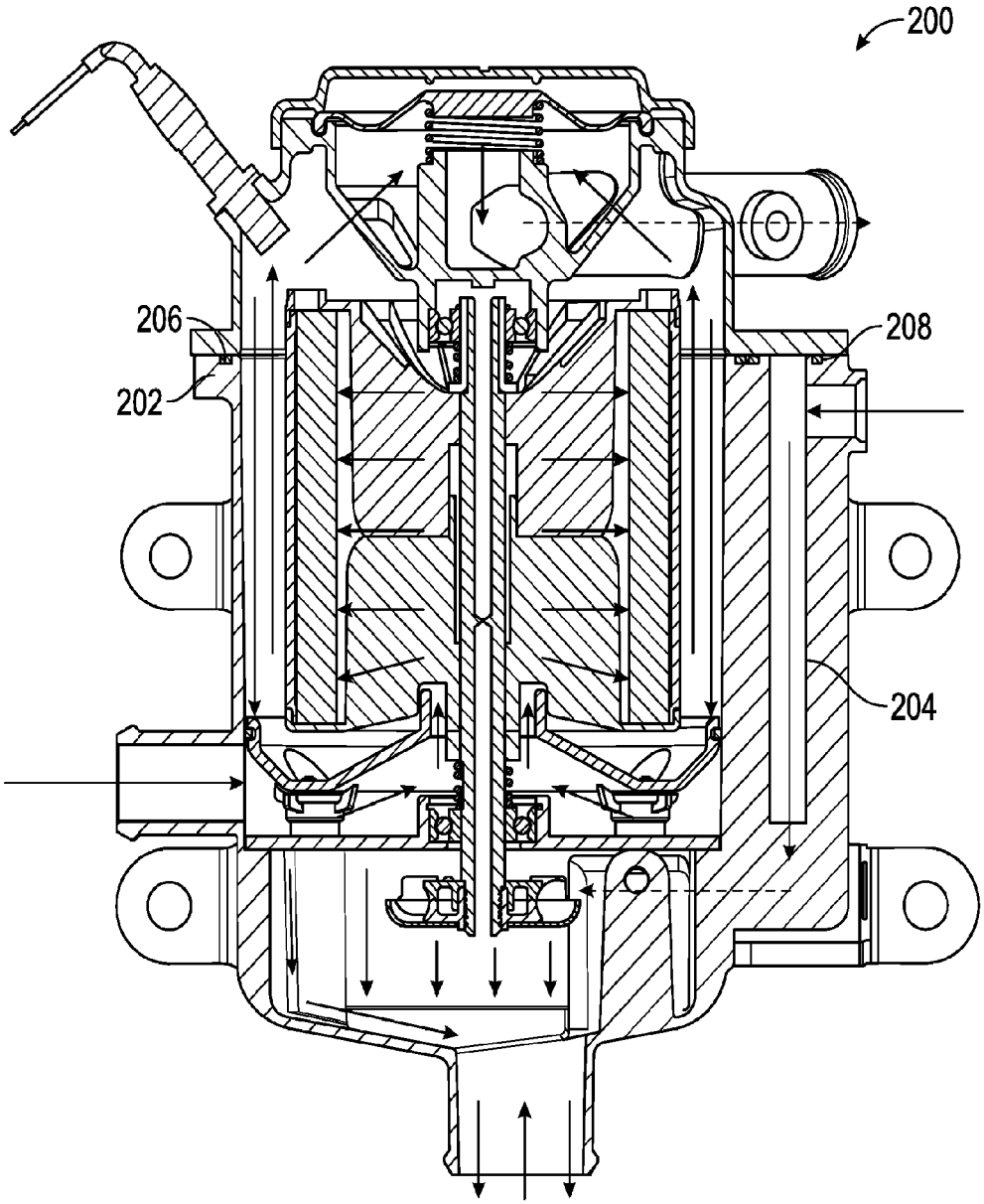
FIG. 2 is a cross-sectional view of a rotating coalescer for a CV system of an internal combustion engine according to another exemplary embodiment.

Referring to FIG. 2, a cross-sectional view of a rotating coalescer 200 for a CV system of an internal combustion engine is shown according to another exemplary embodiment. Rotating coalescer 200 is substantially similar to rotating coalescer 100 in both arrangement of components and function. Rotating coalescer 200 differs in its arrangement of components relative to the two sections of the housing 202. Unlike the rotating coalescer 100, the conduit 204 does not extend into both sections of the housing 202. Rather, the conduit 204 extends along the length of a first section of the housing 202, and the conduit 204 is capped by the second section of the housing 202. The two sections of the housing may be sealed by a first seal 206. The conduit 204 may be sealed by a second seal 208. Like the rotating coalescer 100 of FIG. 1, the conduit 204 of the rotating coalescer is configured to transfer heat from heated engine oil to the housing 202 to provide freeze protection to the components of the rotating coalescer 200. The conduit 204 may be shaped to have a semi-circular cross-section to increase the surface area for heat transfer from the heated engine oil to the rotating coalescer 200.

Figure 3:
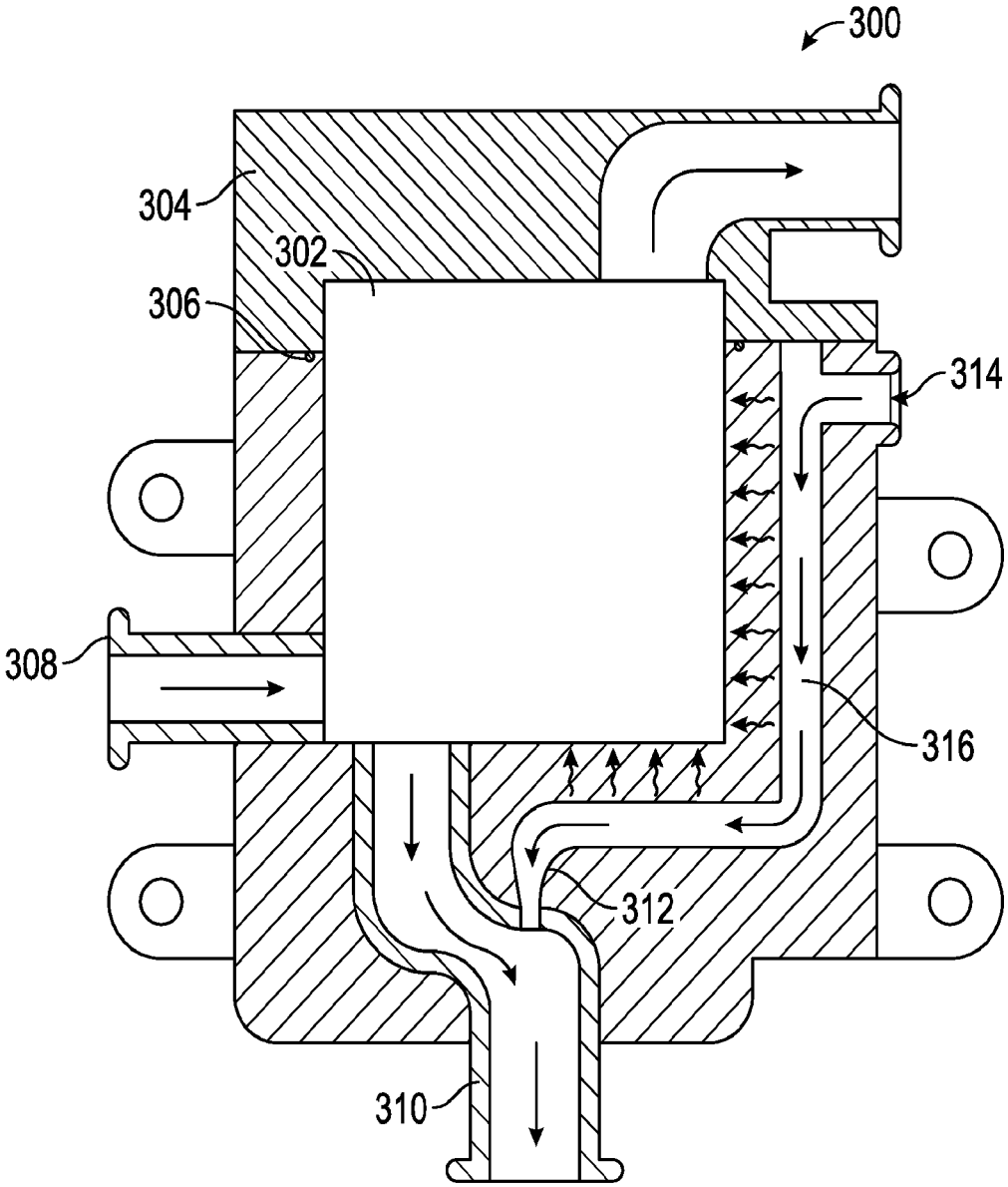
FIG. 3 is a cross-sectional view of a crankcase ventilation filter according to an exemplary embodiment.

Referring to FIG. 3, a CV filter 300 is shown according to an exemplary embodiment. The CV filter element 300 includes a filter element 302 within a housing 304. The housing 304, similar to housings 116 and 202 may be a two-part housing having a first seal 306 between the two sections of the housing 304. The filter element 302 may be coalescing filter, a ventilation rotating filter, a coalescer, an inertial separator, or the like. The filter element is configured to filter blow-by gas received through inlet 308. As described above, the blow-by gas typically includes combustion gases and oil from the engine. The filter element 302 is configured to separate the oil aerosol from the oil contained in the blow-by gas. Oil separated from the blow-by gases by the filter element 302 may be returned to the crankcase via an oil drain 310.

The CV filter 300 includes an oil-driven jet pump system to assist in draining separated oil through the oil drain 310. The jet pump system includes a jet pump nozzle 312 configured to form a high velocity motive jet flow of engine oil through the oil drain 310. The momentum exchange between the high velocity motive jet flow from the jet pump nozzle 312 and the lower velocity surrounding fluid in the oil drain 310 creates a pumping effect which suctions and pumps separated oil from the oil drain 310. The oil within the oil drain 310 may be pumped into the crankcase. The oil used to create the high velocity motive jet flow is engine oil received from a pressurized engine oil source through oil inlet 314. Further details of how an oil-driven jet pump for a CV system works may be found in U.S. Pat. No. 7,870,850, entitled "CRANKCASE VENTILATION SYSTEM WITH PUMPED SCAVENGED OIL," filed on Mar. 22, 2010, issued on Jan. 18, 2011, and assigned to Cummins Filtration IP, Inc., which is hereby incorporated by reference in its entirety and for all purposes.

As in the rotating coalescers 100 and 200, the engine oil received through oil inlet 314 also serves to heat the CV filter 300. The oil is routed through a conduit 316. The conduit 316 may be formed directly in the housing 304 of the CV filter 300. The housing 304 may be formed in a similar manner as discussed above with respect to housing 116. The conduit 316 is substantially similar to conduits 114 and 204 as discussed above with respect to FIGS. 1 and 2. Although shown as only extending along the length of a single section of the housing 304 (in a similar manner to conduit 204), the conduit 316 may also be configured to extend through both sections of the housing 304 (in a similar manner to conduit 114). The engine oil, prior to entering through oil inlet 314, may be heated above the ambient environmental temperature. The engine oil may be heated by the internal combustion engine. In alternative arrangements, the engine oil may be heated by a secondary heating system external to the CV filter 300. Accordingly, as the heated engine oil is routed through the conduit 316, thermal energy from the engine oil is transferred to the housing 306 to provide freeze protection to the components of the CV filter 300. The conduit 316 may be shaped to have a semi-circular cross-section to increase the surface area for heat transfer from the heated engine oil to the CV filter 300.

Figure 4A:
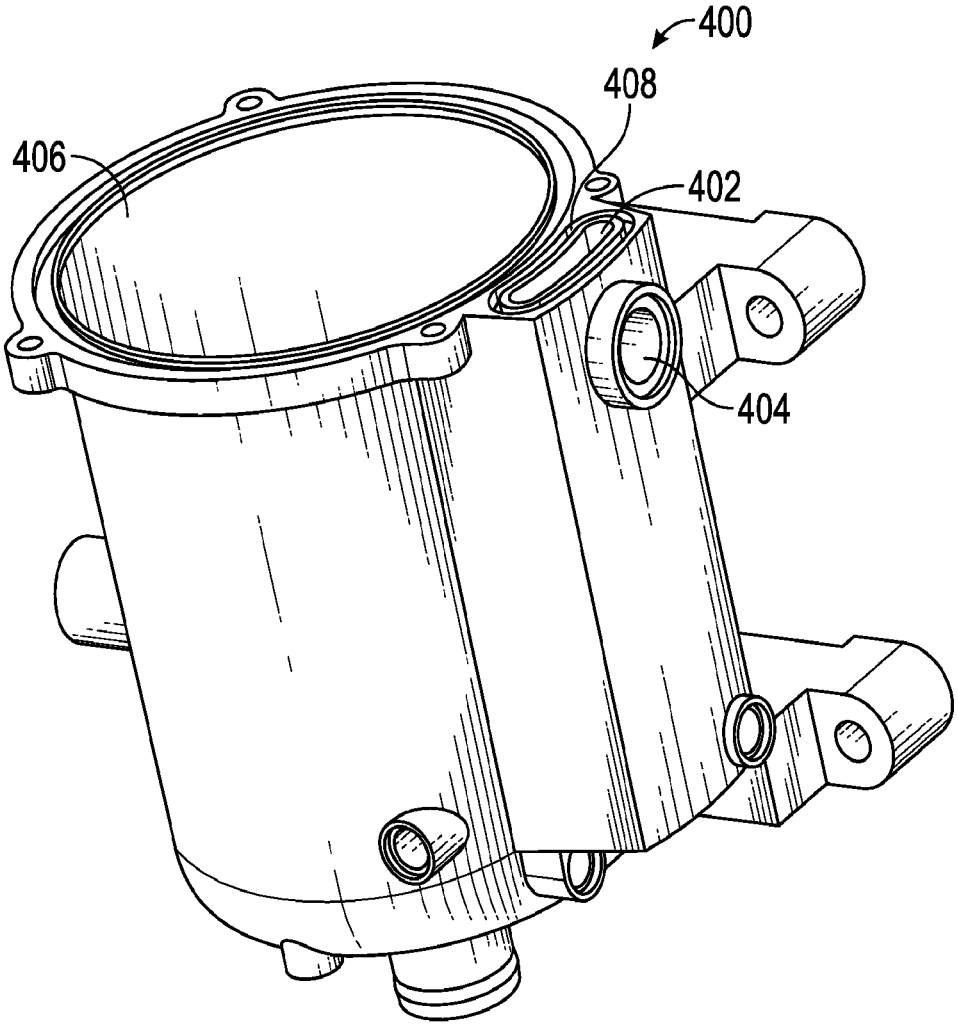
FIGS. 4A and 4B is are perspective views of a portion of a housing according to exemplary embodiments.

Referring to FIG. 4A, a perspective view of a portion of a housing 400 according to an exemplary embodiment. The housing 400 may be a housing used for rotating coalescer 100, rotating coalescer 200, CV filter 300, or the like. The housing includes a conduit 402. The conduit 402 is configured to receive engine oil through an oil inlet 404. The conduit 402 may be shaped to have a semi-circular cross-section. The semi-circular cross section may have a curvature such that the conduit 402 is substantially concentric with the shape of the cavity 406 that receives the filtering components (e.g., the components of rotating coalescer 100, the components of rotating coalescer 200, the components of the CV filter 300, or the like). A groove 408 may be formed around the conduit 402. The groove 408 is sized and shaped to receive a seal such that when a second piece (not shown) of the housing 400 is coupled to the first piece, the conduit is sealed. The conduit 402 may be formed directly in the housing 400. The housing 400 may be formed in a similar manner as discussed above with respect to housing 116.

Figure 4B:
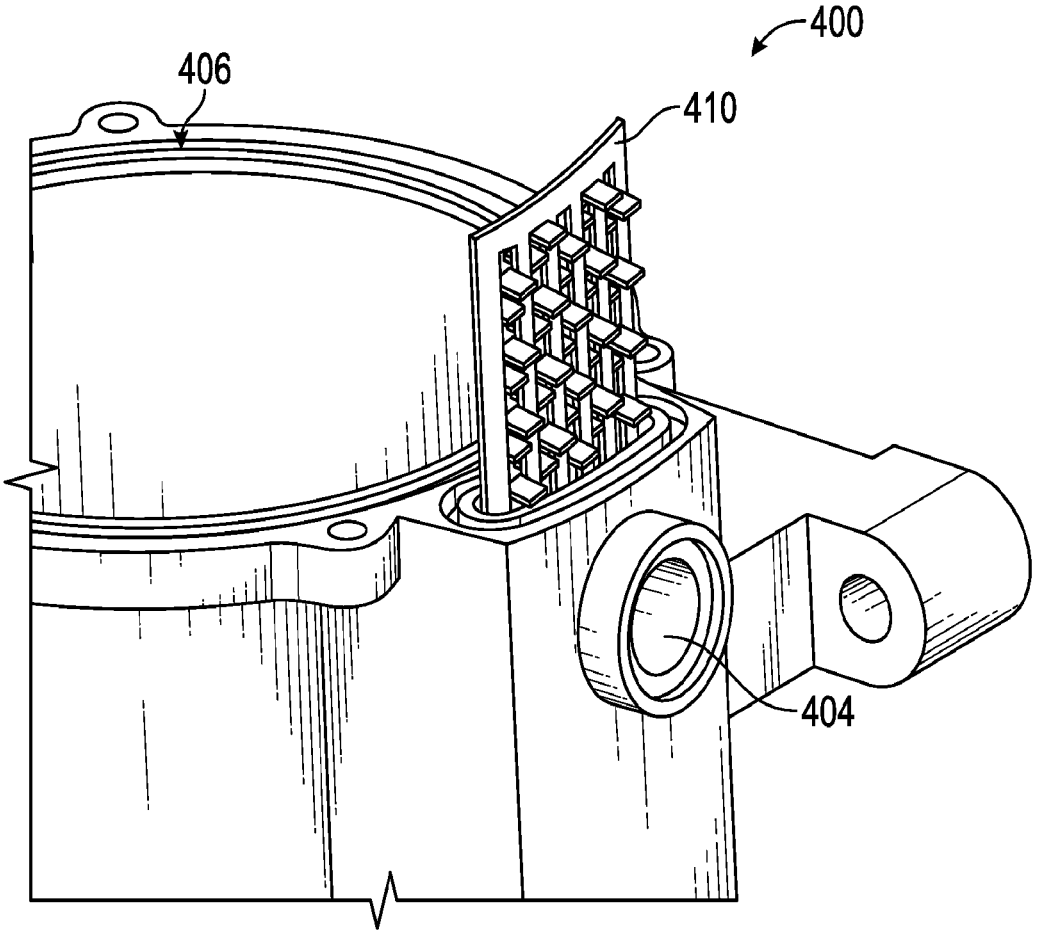
Figure 4C:
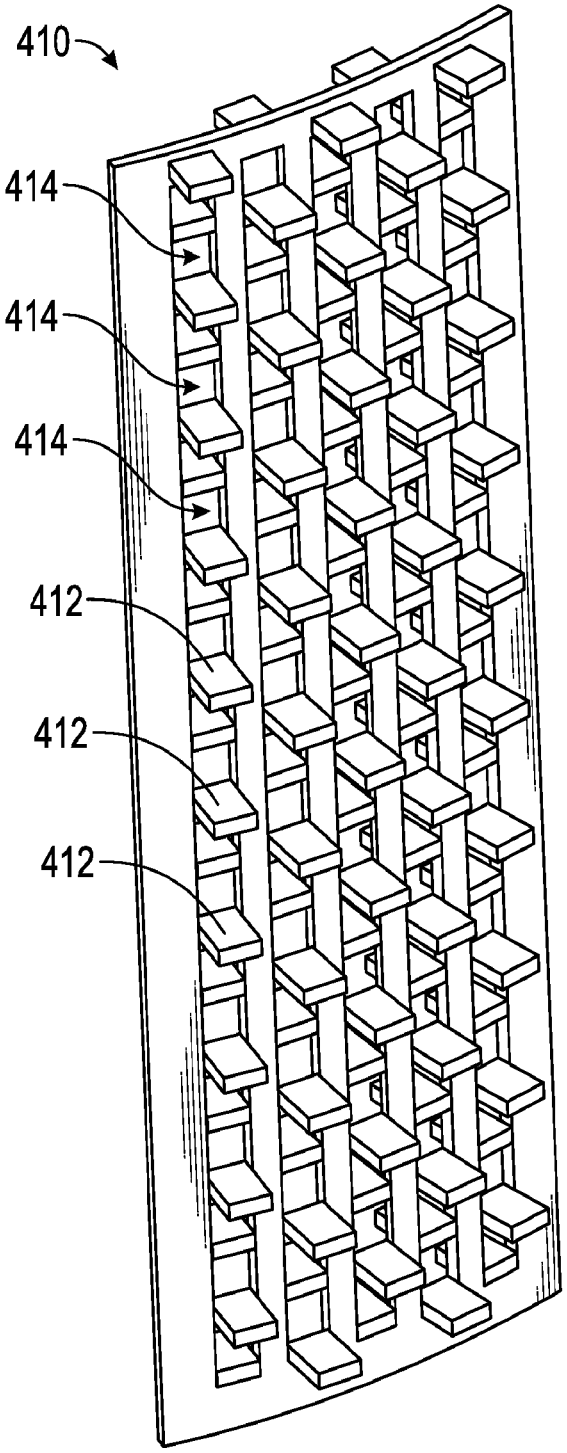
FIG. 4C is a perspective view of the insert of FIGS. 4A and 4C removed from the housing.

In some arrangements, the housing 400 includes an insert 410 positioned within the cavity 406 of the conduit 402. A perspective view of this arrangement is shown in FIG. 4B. FIG. 4C shows a perspective view of the insert 410 removed from the housing 400. The insert 410 includes a plurality of different passages 412 and fins 414 that increase the turbulence of the oil flowing through the cavity 406. The passages 412 are sized and arranged such that the insert 410 does not cause a significant pressure drop to the oil flowing through the cavity 406. The increased turbulence of the oil increases the heat transfer from the oil to the walls of the cavity 406 (e.g., from within the conduit 402) to the CV filter positioned within the housing 400 (e.g., to the CV filter 302). In some arrangements, the fins 414 extend to and contact the inner wall of the cavity 406 to provide additional thermal energy transfer to the wall of the cavity 406. The insert 410 may have a honeycomb arrangement. In particular implementations, the insert may be stamped from a sheet metal, and the metal may be a high thermal conductivity metal, such as aluminum, copper, brass, or the like.

Figure 6:
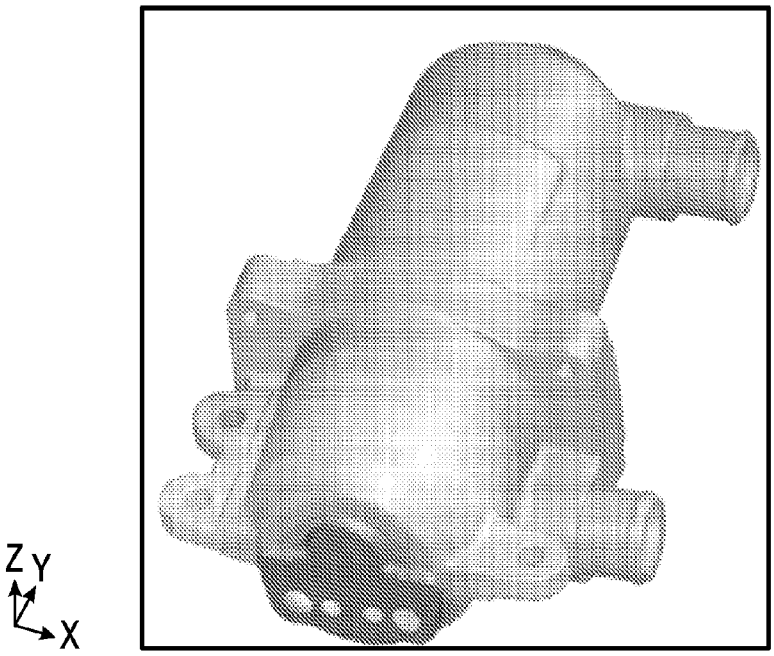
Figure 7:
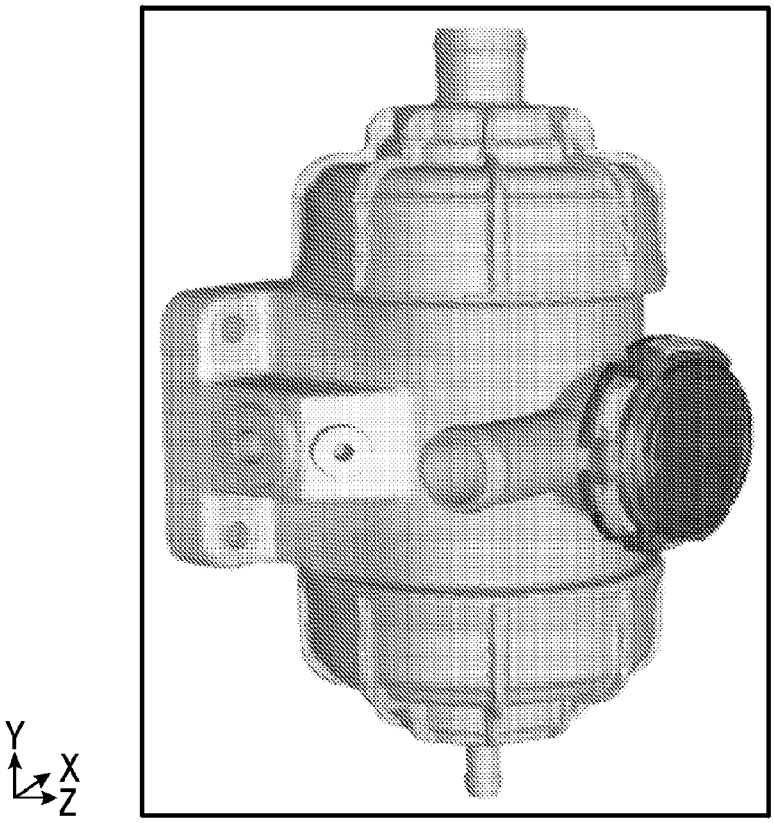

Referring to FIGS. 5-7, various thermal diagrams of CV filter housings are shown according to various embodiments. As shown in the figures, heated engine oil enters the housing and maintains the temperature of the housing above freezing points. For example, as shown in FIG. 5, when the ambient temperature is approximately negative forty degrees Celsius, and the engine oil temperature is approximately fifty degrees Celsius, the CV filter housing maintains a temperature above freezing (e.g., seven degrees Celsius).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Additionally, it should be understood that features from one embodiment disclosed herein may be combined with features of other embodiments disclosed herein as one of ordinary skill in the art would understand. Other substitutions, modifications, changes and omissions may also be made in the design, operating conditions and arrangement of the various exemplary embodiments without departing from the scope of the present invention.

What is claimed is:

1. A crankcase ventilation system comprising:

a housing;

a crankcase ventilation filter element within the housing, the crankcase ventilation filter element configured to separate oil and oil aerosol from blow-by gases from a crankcase;

an oil inlet configured to receive pressurized oil from a component of an internal combustion engine;

a conduit positioned within the housing and positioned along a length of the housing, the conduit configured to carry the pressurized oil from the oil inlet to a component of the crankcase ventilation system, wherein the conduit is configured to transfer thermal energy from the pressurized oil to the housing; and an oil outlet configured to return the pressurized oil to the crankcase.

2. The crankcase ventilation system of claim 1, wherein the conduit is semi-circular in shape.

3. The crankcase ventilation system of claim 1, wherein the component is a pelton wheel, wherein the pelton wheel is configured to rotationally drive the crankcase ventilation filter element.

4. The crankcase ventilation system of claim 1, wherein the component is a motive jet nozzle.

5. The crankcase ventilation system of claim 4, wherein the motive jet nozzle is configured to form a high velocity motive jet of the pressurized oil, and wherein the high velocity motive jet is directed into the oil outlet and creates a pumping effect which suctions and pumps the separated oil from the blow-by gases out of the oil outlet.

6. The crankcase ventilation system of claim 1, wherein the conduit is lined with copper.

7. The crankcase ventilation system of claim 1, wherein the conduit includes internal ribs configured to increase a surface area in contact with pressurized oil routed through the conduit, thereby increasing the thermal energy transfer from the pressurized oil to the housing.

8. The crankcase ventilation system of claim 1, wherein the conduit includes sinusoidal flow channels that create oscillatory flows of the pressurized oil within the conduit.

9. The crankcase ventilation system of claim 1, further comprising an insert positioned within the conduit.

10. The crankcase ventilation system of claim 9, wherein the insert includes a plurality of openings and a plurality of fins that cause turbulence in the pressurized oil flowing through the conduit, thereby increasing the thermal energy transfer from the pressurized oil to the housing.

11. The crankcase ventilation system of claim 10, wherein the fins extend to and contact an inner wall of the conduit.

12. A housing for a crankcase ventilation system, the housing comprising:

a cavity configured to house a crankcase ventilation filter element within the housing;

an oil inlet configured to receive pressurized oil from a component of an internal combustion engine;

a conduit positioned within the housing and positioned along a length of the housing, the conduit configured to carry the pressurized oil from the oil inlet to a component of the crankcase ventilation system, wherein the conduit is configured to transfer thermal energy from the pressurized oil to the housing; and an oil outlet configured to return the pressurized oil to the crankcase.

13. The housing of claim 12, wherein the conduit is semi-circular in shape.

14. The housing of claim 12, wherein the component is a pelton wheel, and wherein the pelton wheel is configured to rotationally drive the crankcase ventilation filter element when the crankcase ventilation filter element is installed within the cavity.

15. The housing of claim 12, wherein the component is a motive jet nozzle.

16. The housing of claim 15, wherein the motive jet nozzle is configured to form a high velocity motive jet of the pressurized oil, and wherein the high velocity motive jet is directed into the oil outlet and creates a pumping effect which suctions and pumps the separated oil from the blow-by gases out of the oil outlet.

17. The housing of claim 12, wherein the conduit is lined with copper.

18. The housing of claim 12, wherein the conduit includes internal ribs configured to increase a surface area in contact with pressurized oil routed through the conduit, thereby increasing the thermal energy transfer from the pressurized oil to the housing.

19. The housing of claim 12, wherein the conduit includes sinusoidal flow channels that create oscillatory flows of the pressurized oil within the conduit.

20. The housing of claim 12, further comprising an insert positioned within the conduit.

21. The housing of claim 20, wherein the insert includes a plurality of openings and a plurality of fins that cause turbulence in the pressurized oil flowing through the conduit, thereby increasing the thermal energy transfer from the pressurized oil to the housing.

22. The housing of claim 21, wherein the fins extend to and contact an inner wall of the conduit.

* * * * *